US006209189B1

(12) United States Patent
Murata

(10) Patent No.: US 6,209,189 B1
(45) Date of Patent: Apr. 3, 2001

(54) AUTOMATIC CUTTING AND SOLDER-LESS CONNECTION APPARATUS

(75) Inventor: Osamu Murata, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/413,544

(22) Filed: Oct. 6, 1999

(30) Foreign Application Priority Data

Oct. 7, 1998 (JP) ..... 10-285562

(51) Int. Cl.[7] ..... H01R 43/00
(52) U.S. Cl. ..... 29/564.4; 29/33 M; 29/753
(58) Field of Search ..... 29/564.4, 33 M, 29/751, 753, 564.8, 566.3, 566.1, 748; 140/1

(56) References Cited

U.S. PATENT DOCUMENTS 4,087,908 * 5/1978 Fuscoell ..... 29/753
5,235,735 * 8/1993 Koch ..... 29/564.4
5,247,732 * 9/1993 Lait et al. ..... 29/33 M X
5,784,770 * 7/1998 Long, Jr. et al. ..... 29/564.4

FOREIGN PATENT DOCUMENTS 6-96630 4/1994 (JP) .

* cited by examiner

*Primary Examiner*—William Briggs
(74) *Attorney, Agent, or Firm*—Finnegan, Henderson, Farabow, Garrett & Dunner, L.L.P.

(57) ABSTRACT

An automatic cutting and solder-less connection apparatus includes: a length measuring unit intermittently feeding a covered electric wire into a predetermined length, the cutting and stripping unit stripping in such a manner that a covered portion of the covered wire is removed from the end of the predetermined length cut wire; an end-treating unit connecting a core wire disclosed by removing the covered portion with a terminal; a conveyor unit transferring the covered electric wire from the down-stream of the covered electric wire toward the up-stream of the covered electric wire; a center process unit deciding whether a length of a product to be produced is in excess of an appropriate length which is previously determined; and a drive control unit controlling the conveyor unit to dive according to the result of the decision by the center process unit.

5 Claims, 3 Drawing Sheets

AUTOMATIC CUTTING AND SOLDER-LESS CONNECTION APPARATUS

BACKGROUND OF THE INVENTION

1. Field of the Invention

The present invention relates to an automatic cutting and solder-less connection apparatus, wherein a covered electric wire rolled and coiled in a wire reel is intermittently uncoiled from the wire reel and being cut by a cutter into a predetermined length; each ends of the predetermined length cut wire is stripped in such a manner that a covered portion of the covered wire is removed from the end of the predetermined length cut wire and that a core wire in the predetermined length cut wire is disclosed; the disclosed core wire is fit into a terminal; and the terminal is made with solder-less connection so as to combining the terminal and the core wire. The present invention relates specifically to an automatic cutting and solder-less connection apparatus, wherein since a belt conveyor unit is controlled to drive corresponding to the variable length of a product to be produced, previous reduction of emergency stop case of the apparatus, previous reduction of no good products causing case and low consumption of electric power are able to be proceeded, even though the length of a product to be produced is variable.

2. Description of the Related Art

A general automatic cutting and crimping apparatus is known by an official gazette, Japanese Patent Application Laid-Open No. 6-96630. The general automatic cutting and crimping apparatus is the construction that covered electric wire is intermittently fed from the wire reel and being cut by a cutter and that each ends of the predetermined length cut wire is stripped in such a manner that a covered portion of the covered wire is removed from the end of the predetermined length cut wire and that a core wire disclosed is fit into a terminal by crimping so as to combining the terminal and core wire.

In the general automatic cutting and crimping apparatus, in case to produce a product having a length excess, for example 50 cm, when an electric wire is fed out with the length of the product to be produced, the fed out portion of the electric wire is jammed against any unit located around the feeder unit, thereby causing emergency stop of the apparatus and causing no good products. Therefore, the fed out portion of the electric wire is required to be restricted from curing or other deforming by any method.

In this connection, an improved apparatus includes a transferring conveyor which is full-time driven to transfer the fed out portion of the electric wire toward the down-stream direction.

According to the general automatic cutting and crimping apparatus, even though the length of a product to be produced is comparatively large, the fed out portion of the electric wire is not jammed against any unit located around the feeder unit, thereby avoiding to cause emergency stop of the apparatus and to cause no good products.

However, since the general automatic cutting and crimping apparatus described above full-time transfers the fed out portion of the electric wire toward the down-stream direction notwithstanding whether the length of a product to be produced is large or small, it is difficult to save consumption of electric power during operation.

Therefore, it is necessary to further improve an apparatus wherein previous reduction of emergency stop case of the apparatus previous reduction of no good products causing case and low consumption of electric power are able to be proceeded, even though the length of a product to be produced is variable.

SUMMARY OF THE INVENTION

The present invention has been achieved with such points in mind.

It is therefore is an object of the present invention to provide an automatic cutting and solder-less connection apparatus, wherein since a belt conveyor unit is controlled to drive corresponding to the variable length of a product to be produced, previous reduction of emergency stop case of the apparatus, previous reduction of no good products causing case and low consumption of electric power are able to be proceeded, even though the length of a product to be produced is variable.

To achieve the object, according to a first aspect of the present invention, there is provided an automatic cutting and solder-less connection apparatus, comprising: a length measuring unit intermittently feeding a covered electric wire; a cutting a stripping unit cutting the covered electric wire into a predetermined length, the cutting and stripping unit stripping in such a manner that a covered portion of the covered wire is removed from the end of the predetermined length cut wire; and end-treating unit connecting a core wire disclosed by removing the covered portion with a terminal; a conveyor unit transferring the covered electric wire from the down-stream of the covered electric wire toward the up-stream of the covered electric wire; a center process unit deciding whether a length of a product to be produced is in excess of an appropriate length which is previously determined; and a drive control unit controlling the conveyor unit to dive according to the result of the decision by the center process unit.

In the automatic cutting and solder-less connection apparatus, depending upon the result that the conveyor unit is controlled to drive corresponding to the variable length of a product to be produced, previous reduction of emergency stop case of the apparatus, previous reduction of no good products causing case and low consumption of electric power are able to be proceeded, even though the length of a product to be produced is variable.

According to a second aspect of the present invention as it depends from the first aspect, there is provided an automatic cutting and solder-less connection apparatus, wherein the drive control unit controls the conveyor unit to dive according to the result of the decision by the center process unit where the length of a product to be produced is in excess of the appropriate length; and the drive control unit controls the conveyor unit to stop the dive according to the result of the decision by the center process unit where the length of a product to be produced is not in excess of the appropriate length.

In this apparatus, according to the control depending upon the variable length of a product to be produced, previous reduction of emergency stop case of the apparatus, previous reduction of no good products causing case and low consumption of electric power are able to be proceeded, even though the length of a product to be produced is variable.

According to a third aspect of the present invention as it depends from the first or the second aspect, there is provided an automatic cutting and solder-less connection apparatus, wherein the conveyor unit transfers the up-stream portion of the electric wire in a direction where the length measuring unit feeds the covered electric wire in such a manner that the electric wire is kept substantially straight.

By the apparatus according to the third aspect of the invention, the up-stream portion of the electric wire is transferred in the same direction where the length measuring unit feeds the covered electric wire, not in reverse direction. Therefore, the same result as by the first aspect is gained.

According to a fourth aspect of the present invention as it depends from the one aspect among the first aspect to the third aspect, there is provided an automatic cutting and solder-less connection apparatus, wherein a transferring speed by the conveyor unit is set the same speed or excess speed of the covered electric wire fed by the length measuring unit.

In this apparatus, since the up-stream portion of the electric wire is transferred at the appropriate speed, the same result as by the first aspect is gained.

According to a fifth aspect of the present invention as it depends from the one aspect among the first aspect to the fourth aspect, there is provided an automatic cutting and solder-less connection apparatus, wherein the length of a product to be produced is determined by process data including substantial data in relation to the product to be produced.

In the apparatus according to the fifth aspect, an automatic cutting and solder-less connection apparatus can be applicable to continuous product line where products are produced with required working treatment according to the process data.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

There will be detailed below the preferred embodiments of the present invention with reference to the accompanying drawings.

Figure 1:
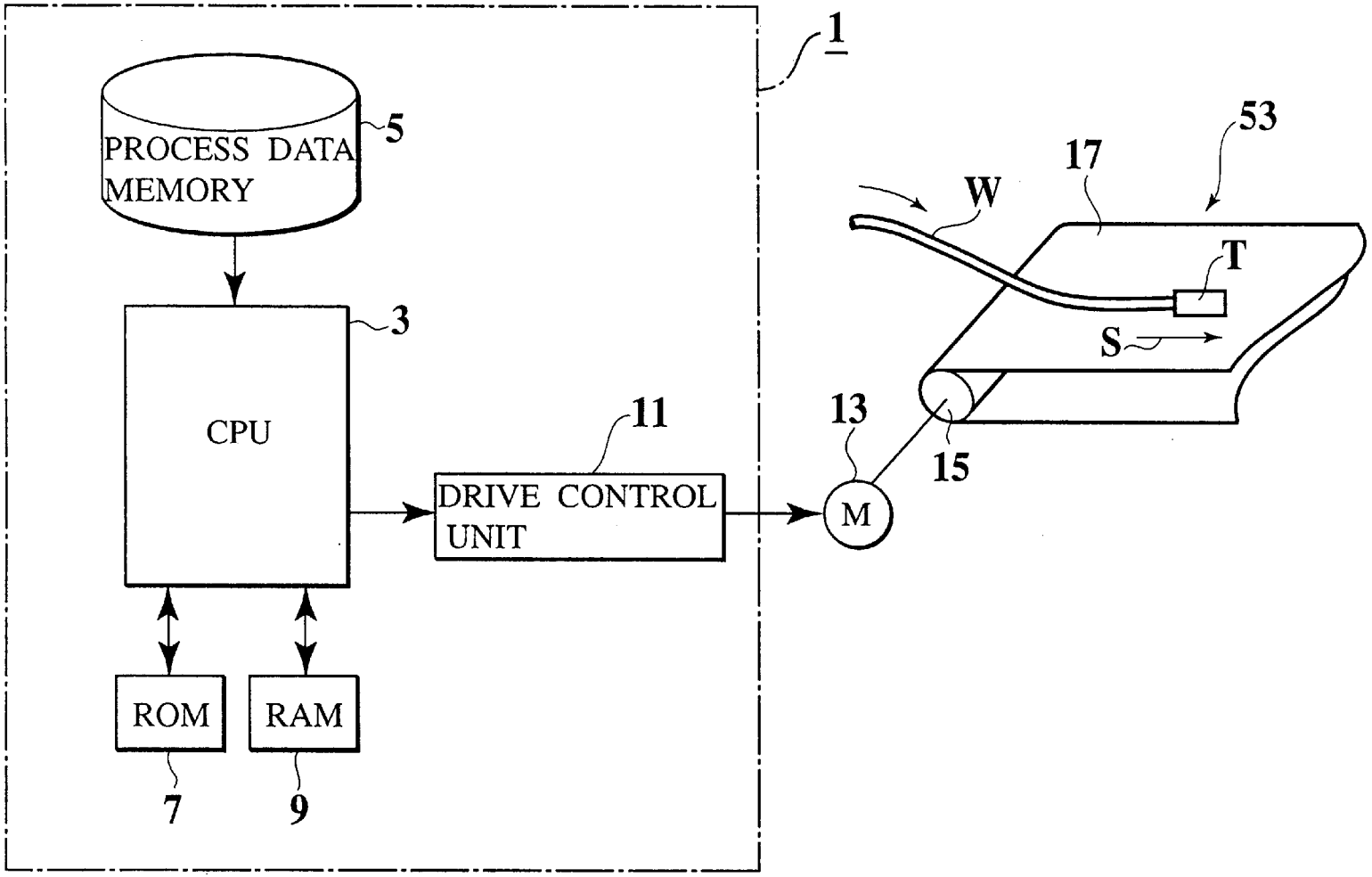
FIG. 1 is a functional block chart of the automatic cutting and solder-less connection apparatus according to the present invention.
Figure 2:
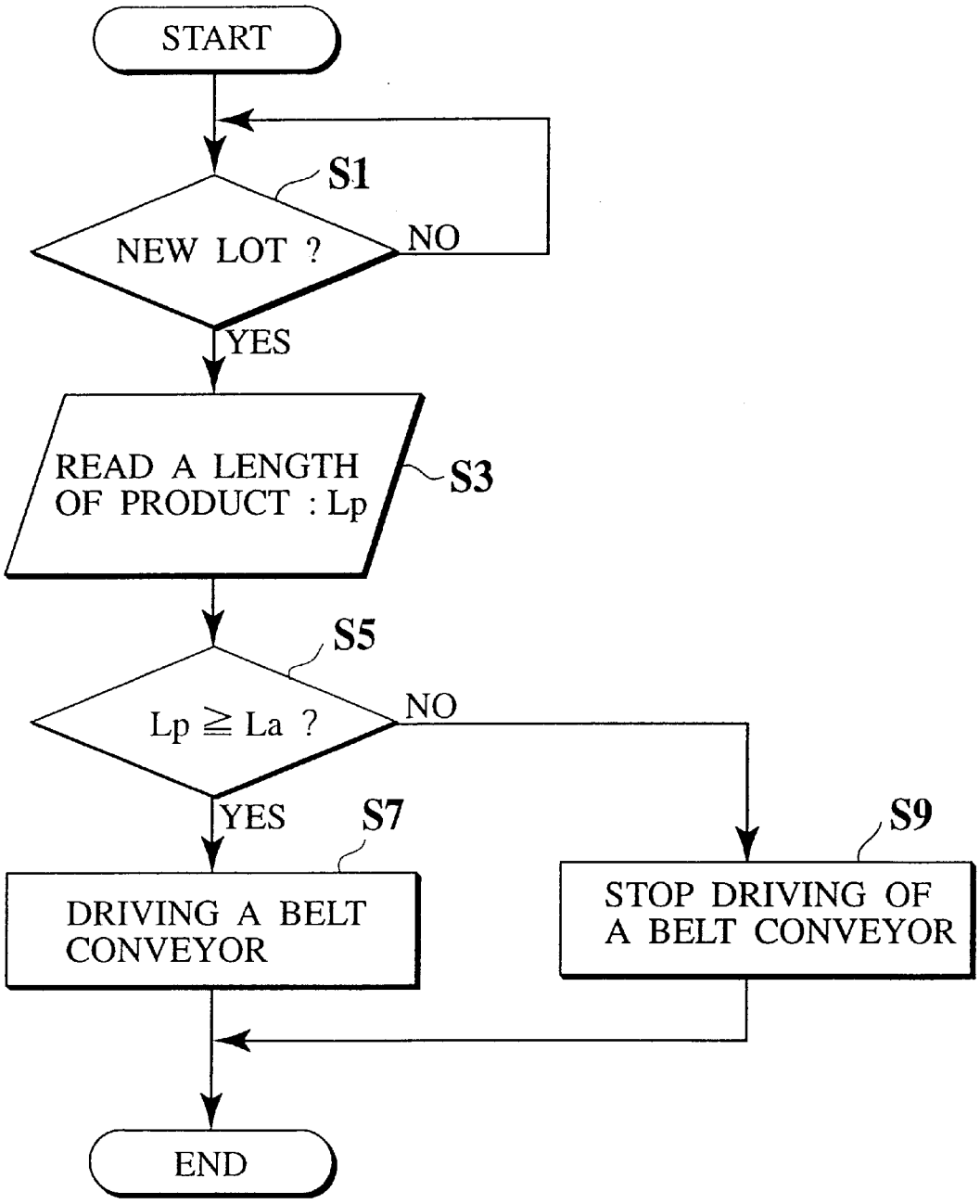
FIG. 2 is a flow chart displaying main functions of the automatic cutting and solder-less connection apparatus according to the present invention.
Figure 3:
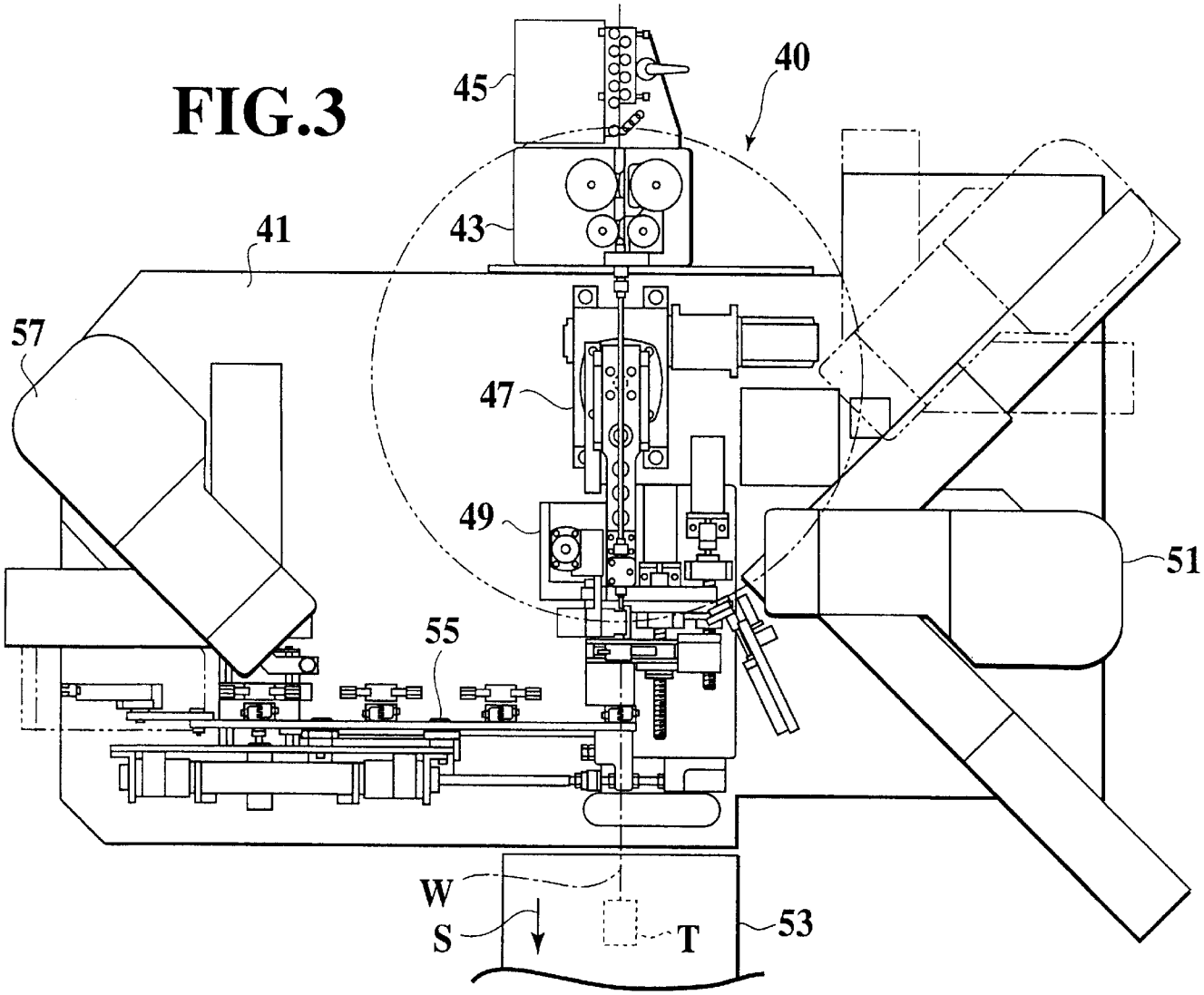
FIG. 3 is a plan view of mechanical structure of the automatic cutting and solder-less connection apparatus according to the present invention.

FIG. 1 shows a functional block chart of the automatic cutting and solder-less connection apparatus according to the present invention. FIG. 2 shows a flow chart displaying main functions of the automatic cutting and solder-less connection apparatus according to the present invention. FIG. 3 shows a plan view of mechanical structure of the automatic cutting and solder-less connection apparatus according to the present invention.

Initially, according to the present invention, there is provided the automatic cutting and solder-less connection apparatus 40: wherein a covered electric wire rolled and coiled in a wire reel is intermittently and interruptedly uncoiled from the wire reel and being cut by a cutter into a predetermined length; each ends of the predetermined length cut wire is stripped in such a manner that a covered portion of the covered wire is removed from the end of the predetermined length cut wire and that a core wire in the predetermined length cut wire is disclosed; the disclosed core wire is fit into a terminal; and the terminal is made with solder-less connection so as to combining the terminal and the core wire. As stated above, required treatments at the end of the predetermined length cut wire are proceeded in the automatic cutting and solder-less connection apparatus according to the present invention. The solder-less connection is made in such a manner that the terminal is crimped on the core wire so as to combine the terminal and the core wire.

In describing more detail, as shown in FIG. 3, the automatic cutting and solder-less connection apparatus 40 includes: a common base 41; a length measuring unit 43 which feeds and measures an electric wire W with a predetermined length of a product to be produced and which is mounted to the common base 41 at a substantially middle and rear end of the common base 41; a corrective unit 45 which removes curl, strain and deformation of the electric wire W uncoiled from a wire reel not shown and feeds the electric wire W into the length measuring unit 43 and which locates at an upstream end of the length measuring unit 43; a transferring turret 47 which selectively positions a forward end of the electric wire W from the length measuring unit 43 toward a cutting and stripping unit 49 or toward a first end-treating unit 51 and which is rotatably and swingably mounted on the common base 41 at a substantially middle and rear end of the common base 41; the cutting and stripping unit 49 which cuts the electric wire W from the length measuring unit 43 into a predetermined length corresponding to a length of a product to be produced and removes a covered portion of the covered electric wire W to disclose a core wire in the predetermined length cut wire and which is mounted to the common base 41 at a substantially middle and front end of the common base 41; and the first end-treating unit 51 which connects a terminal T with the core wire in the predetermined length cut wire by solder-less connection, specifically by crimping and which is mounted on the common base 41 at one end of the common base 41.

The automatic cutting and solder-less connection apparatus 40 according to the present invention further includes: a belt conveyor unit 53 which is operated when the length of a product to be produced exceeds an appropriate length for operating the belt conveyor unit 53 so that the belt conveyor unit 53 transfers the electric wire W in a direction shown by letter S in the figure in such a manner that the electric wire W is kept substantially straight on the belt conveyor unit 53 and which is located at the opposite side of the common base 41 to the length measuring unit 43 as shown in FIG. 3; a straight transferring unit 55 which transfers a previous cut wire being previously cut off from the electric wire W in a previous operating step from a substantially middle and front end of the common base 41 to a second end-treating unit 57. In the previous operating step, the forward end of the predetermined length cut wire is provided a terminal T. The second end-treating unit 57 is located at an opposite side of the common base 41 to the first end-treating unit 51. The straight transferring unit 55 is mounted on the common base 41 toward the second end-treating unit 57.

The automatic cutting and solder-less connection apparatus 40 according to the present invention still further includes: the second end-treating unit 57 which connects another terminal with the other end of core wire in the predetermined length cut wire by solder-less connection, specifically by crimping.

In addition, as shown in FIG. 1, the belt conveyor unit 53 includes a plurality of rollers 15, a driving motor 13 driving at least one of the plurality of rollers 15 and a belt 17 mounted on the plurality of rollers 15 in such a manner that the belt 17 circles around the plurality of rollers 15.

Referring now FIG. 1, an inner construction of a control unit 1 which constructs a part of the automatic cutting and solder-less connection apparatus 40 and which has a function operating the automatic cutting and solder-less connection apparatus 40 will be explained hereinbelow.

As shown in the figure, the control unit 1 includes: a CPU 3 which operates as a center process unit controlling the operations of the automatic cutting and solder-less connection apparatus 40; process data memory 5 which stores process data including substantial data in relation to a product to be produced; a ROM 7 which operates as a read only memory storing operation program and other programs; a RAM 9 which operates as a random access memory and which stores an appropriate length LA previously determined taking into consideration of a length of belt conveyor unit 53 and the other units and which further stores other data; and drive control unit 11 which operate as drive control means controlling the driving motor 13 constituting the belt conveyor unit 53.

Next, operation of the automatic cutting and solder-less connection apparatus 40 according to the present invention will be described hereinafter, referring to the operational flow chart as shown in FIG. 2.

In a step S1, after refers the process data stored in the process data unit 5, the CPU 3 decides whether a new lot production is begun or not.

According to the result of the decision in the step S1, in case the CPU 3 decides that a new lot production is begun, the CPU 3 reads a length of a product Lp to be produced in the new lot production and reads the appropriate length La, in a step S3.

In a step S5, the CPU 3 decides whether the length of a product Lp is grater than the appropriate length La or not. Specifically, whether the length of a product Lp is equal to the appropriate length La and whether the length of the product Lp excesses the appropriate length La.

According to the result of the decision in the step S5, in case the CPU 3 decides that the length of a product Lp is equal to the appropriate length La or that the length of the product Lp excesses the appropriate length La, in a step 7, the CPU 3 further decides that the upstream side of the electrical wire W is required to be transferred toward downstream by the belt conveyor unit 53, in the direction S as shown in FIG. 1 so as to keep the upstream side portion of the electrical wire W straight even though the electrical wire W is continuously fed from the transferring turret 47.

Consequently, the CPU 3 orders and controls the drive control unit 11 to order and to control the driving motor 13 to rotate at a predetermined speed so as to drive the belt conveyor unit 53 at a predetermined transferring speed, thereby proceeding with a production operation.

At this time, since the feeding speed of the electric wire W by the length measuring unit 43 and the transferring speed of the up-stream portion of the electric wire W by the belt conveyor unit 53 are synchronizedly controlled, the upstream side portion of the electrical wire W can be kept straight in the direction S as shown in FIG. 1 even though the electrical wire W is continuously fed from the transferring turret 47.

On the other hand, according to the result of the decision in the step S5, in case the CPU 3 decides that the length of a product Lp does not excess the appropriate length La, in a step 9, the CPU 3 further decides that the upstream side of the electrical wire W is not required to be transferred toward downstream by the belt conveyor unit 53.

Consequently, the CPU 3 orders and controls the drive control unit 11 to order and to control the driving motor 13 to stop the rotation so as to stop the drive of the belt conveyor unit 53, thereby proceeding with stopping production.

As described above, according to the automatic cutting and solder-less connection apparatus 40 of the present invention, depending upon the result that the belt conveyor unit 53 is controlled to drive corresponding to the variable length of a product to be produced, previous reduction of emergency stop case of the apparatus, previous reduction of no good products causing case and low consumption of electric power are able to be proceeded, even though the length of a product to be produced is variable.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. An automatic cutting and solder-less connection apparatus, comprising:

a length measuring unit intermittently feeding a covered electric wire;

a cutting and stripping unit cutting the covered electric wire into a predetermined length, the cutting and stripping unit stripping in such a manner that a covered portion of the covered wire is removed from the end of the predetermined length cut wire;

an end-treating unit connecting a core wire disclosed by removing the covered portion with a terminal;

a conveyor unit, driveable in an upstream direction and an opposite downstream direction, for receiving the covered electric wire from the end-treating unit;

a center process unit deciding whether a length of a product to be produced is in excess of an appropriate length which is previously determined; and a drive control unit controlling the conveyor unit to drive in either the downstream or upstream direction according to the result of the decision by the center process unit.

2. An automatic cutting and solder-less connection apparatus according to claim 1, wherein the drive control unit controls the conveyor unit to drive according to the result of the decision by the center process unit where the length of a product to be produced is in excess of the appropriate length; and wherein the drive control unit controls the conveyor unit to stop the drive according to the result of the decision by the center process unit where the length of a product to be produced is not in excess of the appropriate length.

3. An automatic cutting and solder-less connection apparatus according to claim 1, wherein the conveyor unit includes means to transfer the up-stream portion of the electric wire in a direction where the length measuring unit feeds the covered electric wire in such a manner that the electric wire is kept substantially straight.

4. An automatic cutting and solder-less connection apparatus according to claim 1, wherein the conveyor unit includes means for setting a transfer speed to the same speed of the covered electric wire fed by the length measuring unit.

5. An automatic cutting and solder-less connection apparatus according to claim 1, including means of determining the length of the product to be produced by process data including substantial data in relation to the product to be produced.

* * * * *

UNITED STATES PATENT AND TRADEMARK OFFICE

CERTIFICATE OF CORRECTION

PATENT NO. : 6,209,189 B1
DATED : April 3, 2001
INVENTOR(S) : Osamu Murata

It is certified that error appears in the above-identified patent and that said Letters Patent is hereby corrected as shown below:

Title page,
Item [57], ABSTRACT,
Line 3, after "electric wire", insert -- ; a cutting and stripping unit cutting the covered electric wire --.
Line 14, "dive" should read -- drive --.

Signed and Sealed this

Eighteenth Day of June, 2002

*Attest:*

*Attesting Officer*

JAMES E. ROGAN
*Director of the United States Patent and Trademark Office*